US006684913B2

(12) United States Patent
Rivola

(10) Patent No.: US 6,684,913 B2
(45) Date of Patent: Feb. 3, 2004

(54) METHOD FOR LOADING CERAMIC TILE FORMING MOULDS, PLANT FOR ITS IMPLEMENTATION, AND TILES OBTAINED THEREBY

(75) Inventor: Pietro Rivola, Imola (IT)

(73) Assignee: Sacmi-Cooperativa Meccanici Imola-Soc. Coop. A.R.L., Bologna (IT)

( * ) Notice: Subject to any disclaimer, the term of this patent is extended or adjusted under 35 U.S.C. 154(b) by 21 days.

(21) Appl. No.: 10/189,254

(22) Filed: Jul. 5, 2002

(65) Prior Publication Data

US 2003/0006525 A1 Jan. 9, 2003

(30) Foreign Application Priority Data

Jul. 5, 2001 (IT) ..... RE01A0072

(51) Int. Cl.[7] ..... B65D 1/04

(52) U.S. Cl. ..... 141/1; 141/67; 141/125; 425/219; 425/260; 425/448; 425/96

(58) Field of Search ..... 425/219, 218, 425/260, 448, 96, 98; 141/67, 125, 124, 256, 280

(56) References Cited

U.S. PATENT DOCUMENTS 4,758,148 A * 7/1988 Jidell ..... 425/219
5,820,802 A * 10/1998 Oberoi ..... 264/145
6,336,480 B2 * 1/2002 Gaylo et al. ..... 141/12

* cited by examiner

*Primary Examiner*—Steven O. Douglas
(74) *Attorney, Agent, or Firm*—Browdy and Neimark

(57) ABSTRACT

Method for loading ceramic moulds presenting a die plate having at least one forming cavity in which a die is slidingly received, comprising the following operative steps for each complete loading cycle: preparing a powder layer at least the upper part of which has properties conforming to the required aesthetic characteristics of the exposed face of the tile; transferring said layer to above said at least one forming cavity; depositing into said at least one cavity a powder layer having a thickness greater than that necessary to obtain the desired tile thickness, and before pressing removing, by a mechanical cutting action with simultaneous removal of the thus separated material, the surface layer of the powder contained in the mould cavity, without appreciable mixing of the powder present at the interface between the surface layer and the underlying layer.

27 Claims, 5 Drawing Sheets

METHOD FOR LOADING CERAMIC TILE FORMING MOULDS, PLANT FOR ITS IMPLEMENTATION, AND TILES OBTAINED THEREBY

This invention relates in a totally general manner to the manufacture of ceramic tiles, and more particularly concerns a method for loading powder materials into the relative forming moulds.

The invention also relates to the means for implementing said method, and the materials obtained thereby.

The ceramic tile manufacturing sector is known to constantly seek new and original ornamental motifs, and in particular decorations reproducing the appearance of natural stone, such as marble, which is known to present veining and elongate striations of various shapes and colours.

Decorative motifs reproducing said appearance typical of marble can be obtained by the modern ceramic technology involved in the manufacture of fine porcellainized sandstone, which is well known to the expert of this sector, and will therefore not be described in detail.

It is sufficient to state that such decorative motifs can concern either the entire bulk, i.e. the entire thickness of the tile, or just the layer located at the exposed face of said tile.

In particular, in the second case double loading is effected, the first loading using a base material of not particular value intended to form the tile support, whereas the second uses a finishing material, i.e. possessing properties such as to provide the desired characteristics of the exposed face of the tile.

Said second material can consist of at least two at least partly mixed powders having different characteristics, typically different colours.

The invention relates to both said loading methods.

For simplicity, express reference will be made hereinafter to tiles decorated throughout their bulk, it being however understood that that stated is also valid for tiles decorated through only a part of their bulk.

Such bulk-decorated tiles are known to be formed by moulds comprising at least one forming cavity which is filled by a suitable loading carriage provided with a loading compartment for retaining the powders, the loading compartment being usually provided with a grid.

The carriage is driven with horizontal reciprocating rectilinear movement between a retracted position in which it disposes the grid in correspondence with a powder supply station, and an advanced position in which it disposes the grid above said at least one forming cavity, where the powders fall by gravity.

In certain cases the powder mass consisting of at least two at least partly mixed materials having different characteristics, typically different colours, is directly loaded into the grid, whereas in other cases said two materials are contained in respective hoppers located above the grid.

In all cases the grid presents a capacity greater than that of the forming cavity, in order to obtain complete filling of said forming cavity, and hence the desired tile thickness.

Moreover the lower generators of the grid are normally positioned in line with the upper face of the die plate, which defines the upper edge of the forming cavity, in front of the grid there usually being provided a scraper which during the carriage retraction movement smoothes the material deposited in the forming cavity. In some cases the grid can be slightly spaced from the die plate.

Said carriage retraction movement causes excess material still present within the grid to slip onto the surface layer of the material present in the forming cavity, with the result that the original powder distribution is altered.

In particular said masses mix together to generate a surface layer or sheet of virtually uniform colour.

The resultant aesthetic effect is obviously unacceptable, to expose the tile decoration it then being necessary to carry out a grinding operation aimed at removing said surface layer of uniform colour in order to expose the true distribution of the underlying multi-colour powders.

This involves fairly considerable costs, due in particular to the necessary equipment, and problems related to the containing and disposal of the fine powders produced by such machining.

In addition it is not possible to produce tiles having irregular surfaces, for example raised or projecting portions reproducing the splits in natural stone, as said grinding destroys such irregularities.

An object of the invention is to provide a method able to overcome said problems, in particular able to eliminate said surface defects due to said slippage during the filling of the mould forming cavity, in order not to require subsequent finishing operations on the tile once fired.

Another object is to provide a method by which tiles can be obtained having their exposed face not only multi-coloured but also irregular, for example provided with projections recalling the splitting of natural stone.

Another object is to provide means for implementing said method within the context of a simple, rational, reliable, long-lasting and low-cost construction.

Said objects are attained by virtue of the characteristics indicated in the claims.

The characteristics and merits of the invention will be apparent from the ensuing detailed description thereof given with reference to the figures of the accompanying drawings, which illustrate by way of non-limiting example three preferred embodiments of the means for implementing the method of the invention.

Figure 1:
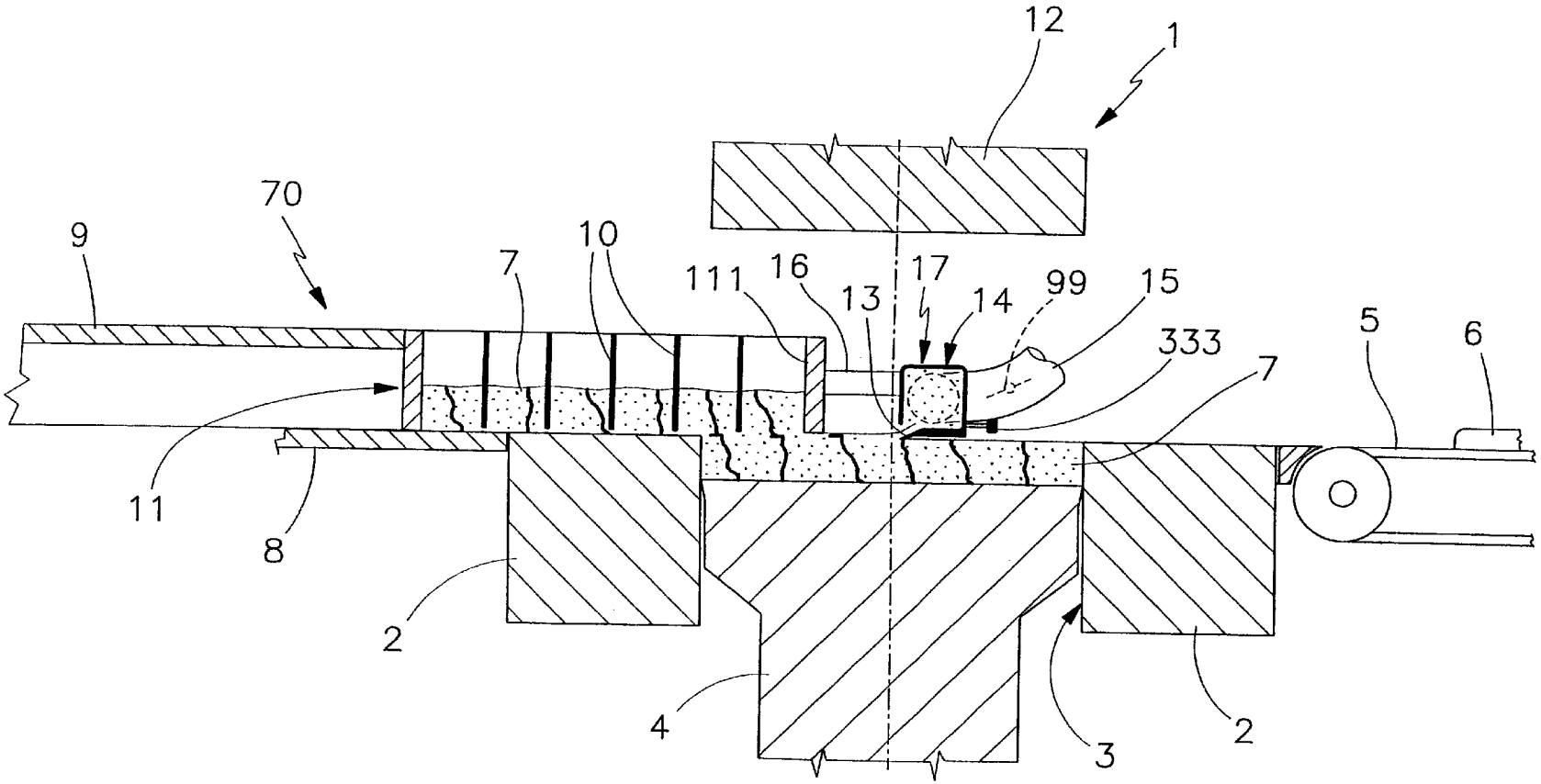
FIG. 1 is a side section schematically showing the means of the invention associated with usual loading carriage of a ceramic mould.
Figure 2:
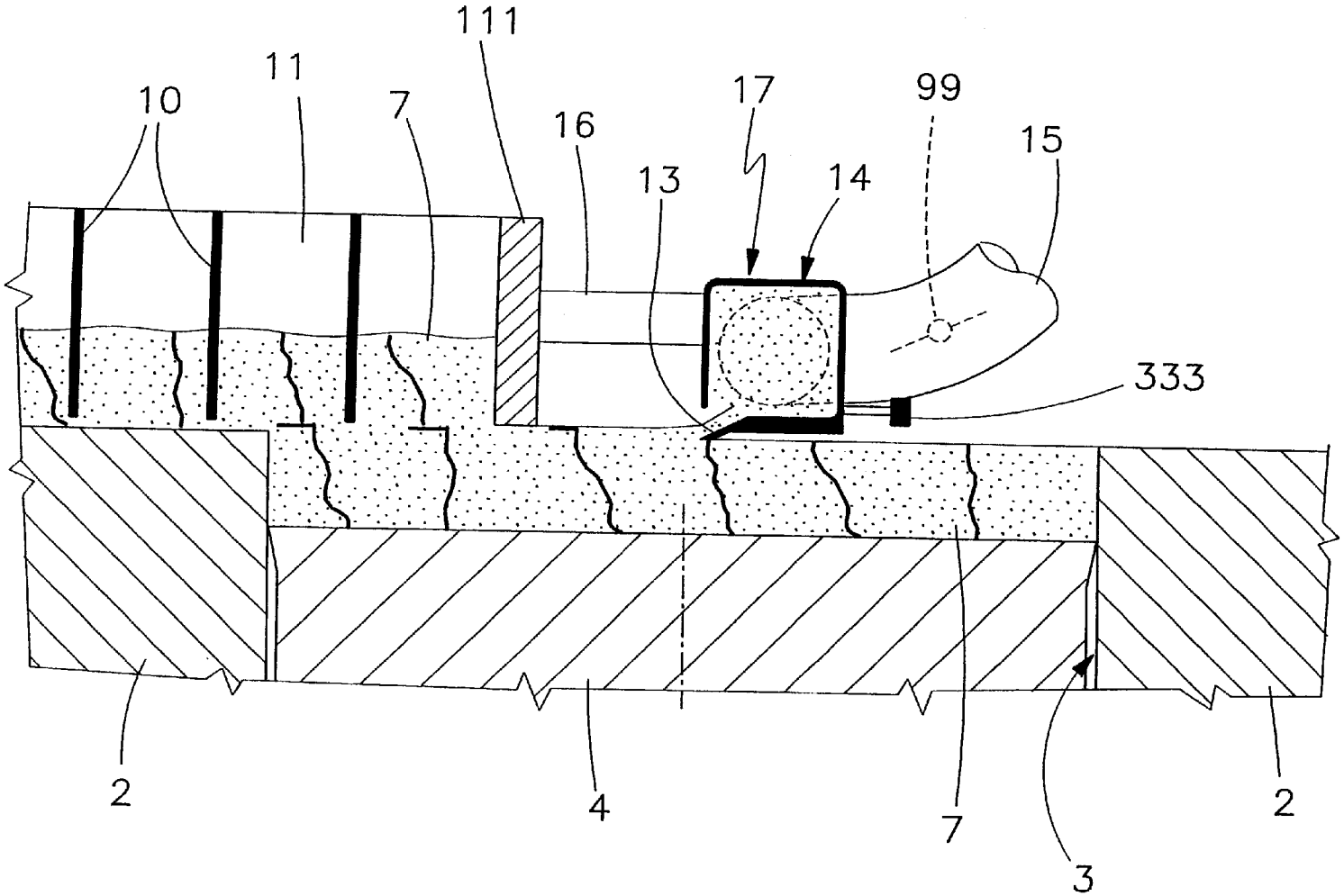
FIG. 2 shows a part of FIG. 1 on a larger scale.
Figure 3:
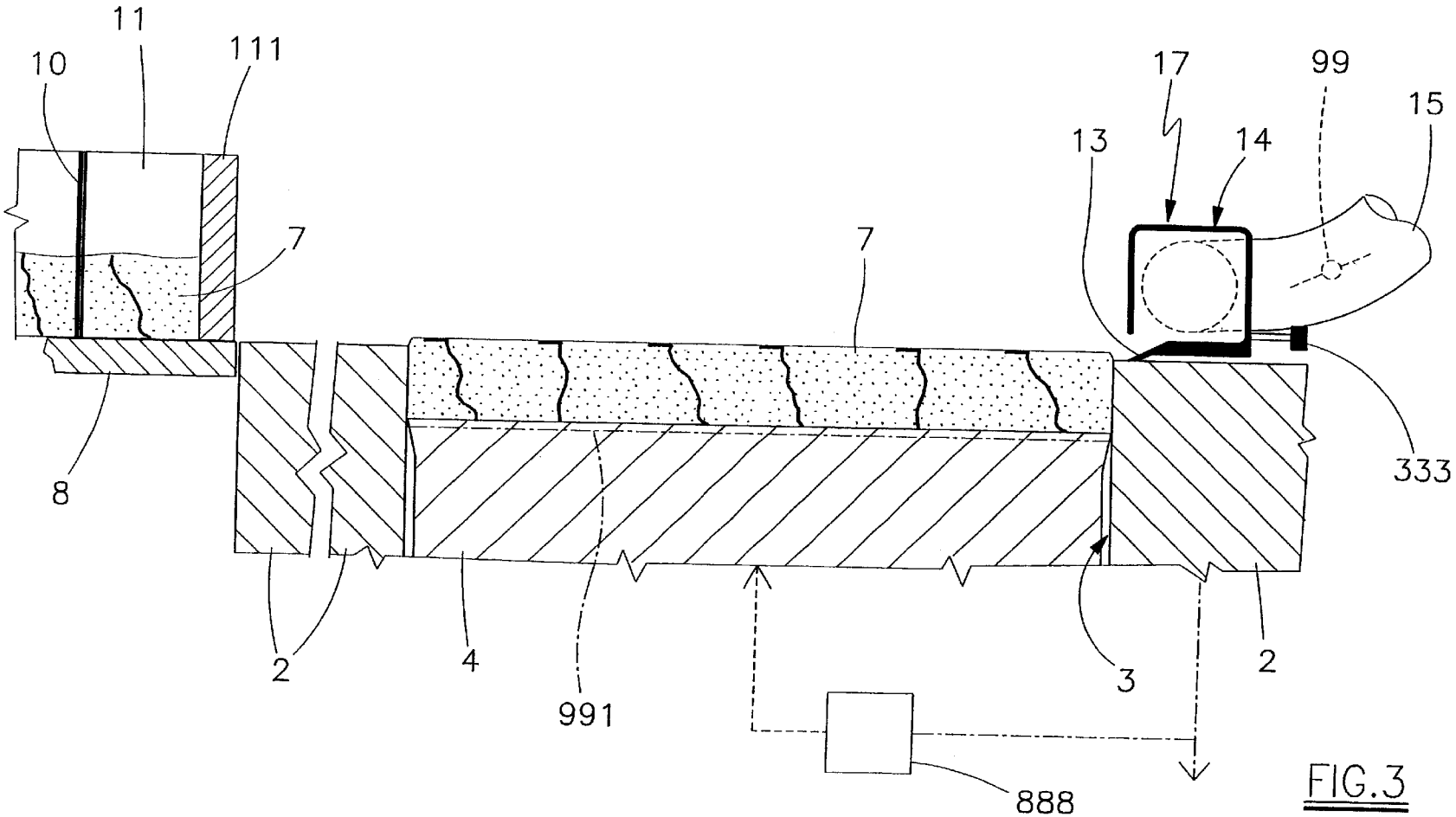
FIG. 3 is a view similar to the preceding, showing a modified embodiment of the means for implementing the method of the invention.

Said figures, and in particular FIGS. 1 to 3, show a usual ceramic mould, indicated overall by the reference numeral 1, comprising a die plate 2 having a single forming cavity 3, a lower die 4 slidingly received within said forming cavity 3, and an upper die 12 carried by the movable crosspiece of a ceramic press, not shown because of known type.

It should be noted that the mould 1 can have any number of forming cavities 3. The die plate 2 and the die 4 are positioned on the bed of the ceramic press by means of known devices able to adjust their height as required.

On one side of the mould 1 there is a conveyor 5 for removing the formed tiles 6, and on the other side there is a horizontal operating table 8 with which a unit 70 for loading the multi-colour powder 7 into said cavity 3 is associated.

Said unit 70 comprises a carriage 9 which is driven with horizontal reciprocating rectilinear movement and is provided at its front with a loading compartment 11 comprising a grid 10. The grid 10 can have a lattice configuration different from that shown, as is well known to the expert of the art.

The carriage 9 and the grid 10 translate between a retracted position in which the grid 10 lies in correspondence with a loading station for the multi-colour powders 7, and an advanced position in which it lies above the cavity 3.

In FIG. 3 the lower edges of the loading compartment 11 and grid 10 are in contact with the upper face of the table 8 and of the die plate 2. In the embodiment of FIGS. 1 and 2, the lower edge of the front transverse wall 111 of the loading compartment 11 and the lower edges of the grid 10 are spaced from the table 8 by a small amount.

For the purposes of the invention, said amount can be between 0.1 and 4 mm.

As a variant, the lower wall 111 can be made to slide vertically to be adjusted in height according to requirements, together with the grid 10.

Said adjustment can be made by manual means, such as threaded members, or by automatic means controlled by the general ceramic press control system.

Figure 4:
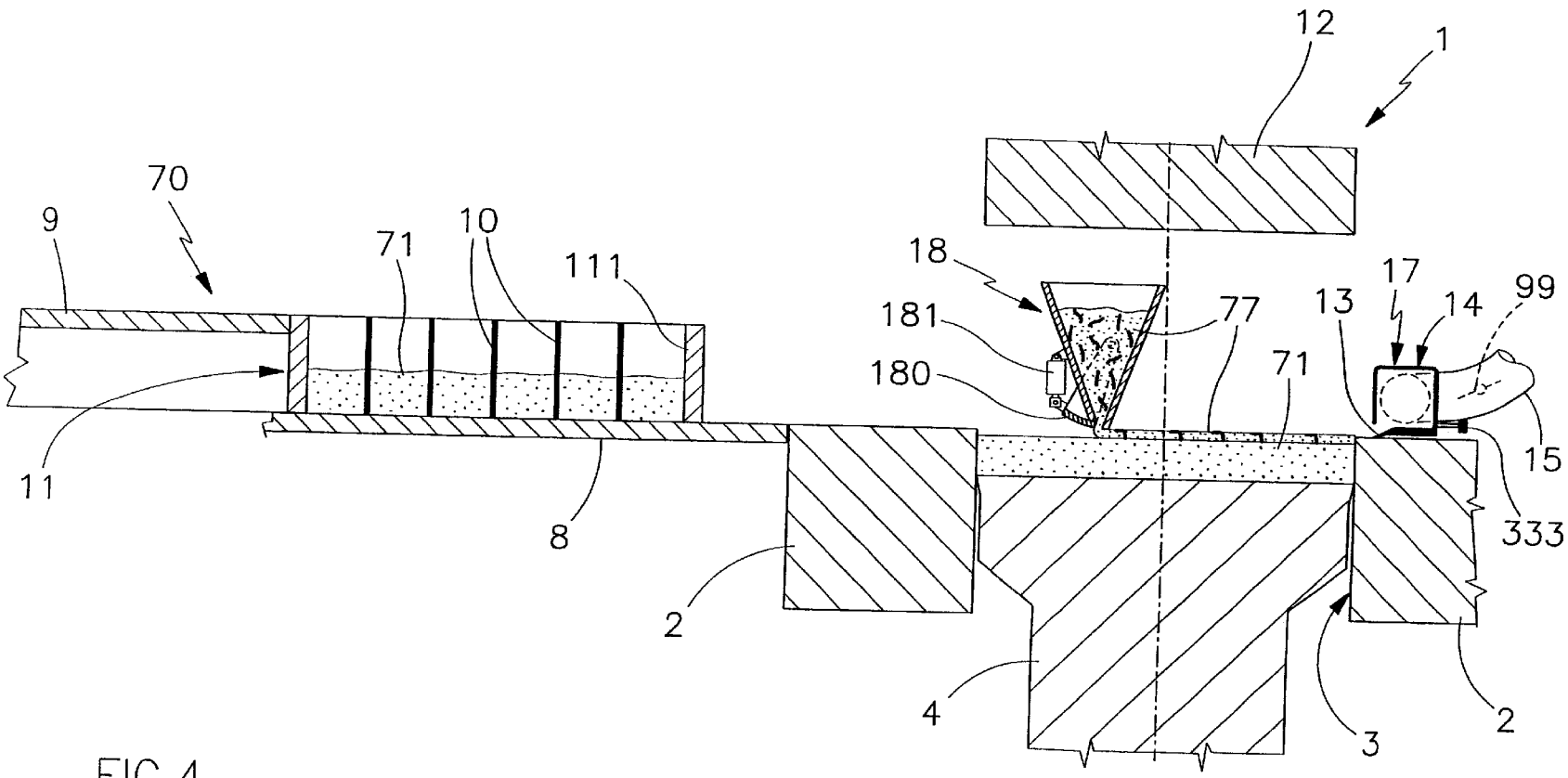
FIG. 4 is a schematic view similar to that of FIG. 1, showing the means of the invention associated with a loading unit operating in accordance with the double loading technique.

In front of said wall 111 there can be seen in FIGS. 1–3 a surface finishing unit 17 for the powder layer associated with the cavity 3, and in FIG. 4 a hopper 18 in addition to the finishing unit 17.

Figure 5:
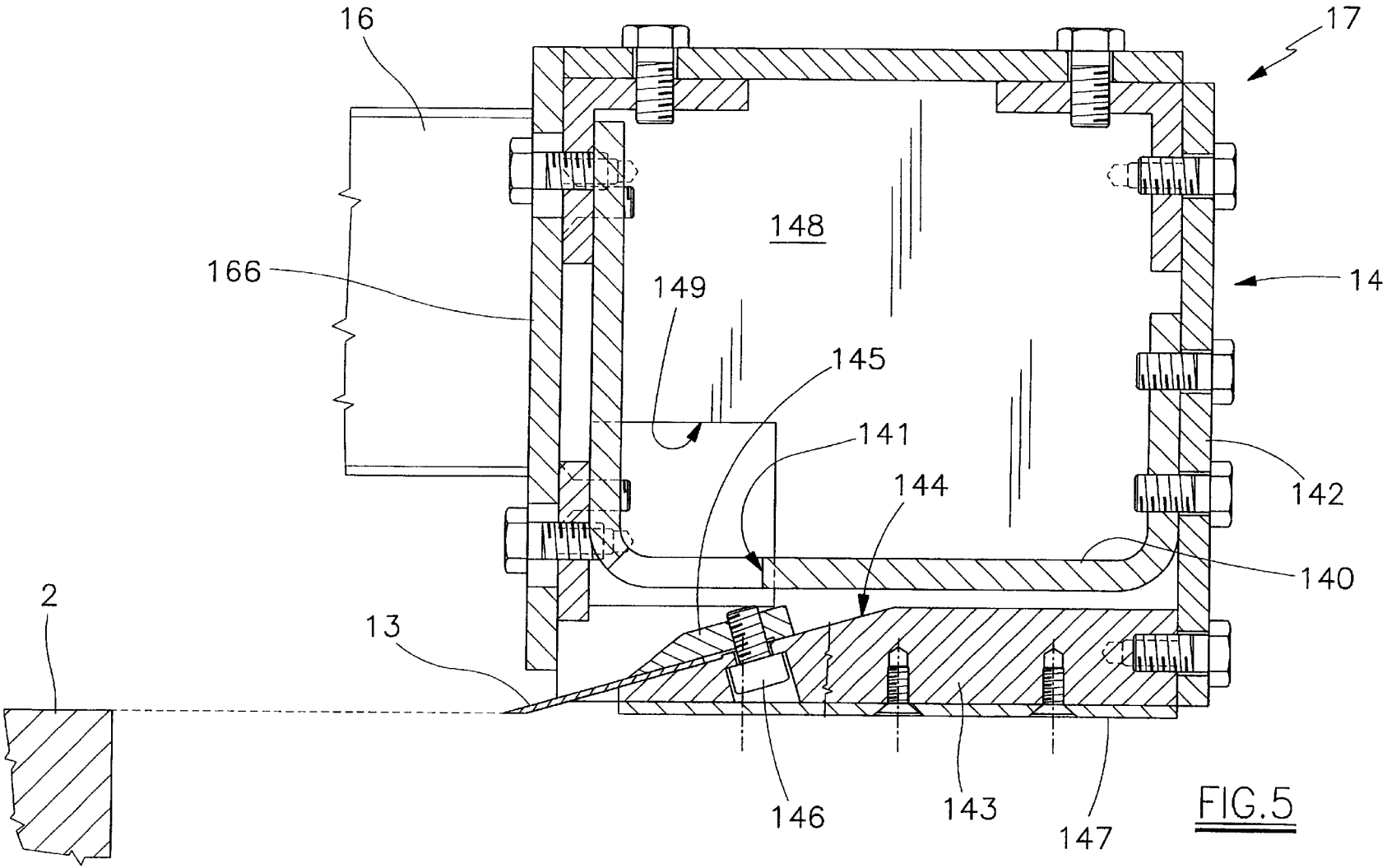
FIG. 5 is a more detailed section through the surface finishing means of the invention.

As can be seen from all the accompanying figures, said finishing unit 17 comprises a horizontal tubular member 14 of right cross-section positioned transversely to the direction of movement of the carriage 9, and having a length exceeding the corresponding dimension of the cavity 3. Said tubular member 14 is formed by joining together, using threaded members, a series of flat and profiled elements, which are shown in FIG. 5 but need not be described in detail.

It is sufficient to state that the lower wall of the member 14, provided by the base wall of a channel section indicated by 140, presents on that side facing the front wall 111 of the loading compartment 11, a port 141 having a length at least equal to that dimension of the cavity 3 in the direction in which the carriage 9 slides. Moreover, the front wall 142 of the member 14 extends beyond the base of said channel section 140, where it supports a bracket 143 which extends towards said port 141. The bracket 143 terminates with a wide bevel 144 which is inclined downwards towards the wall 111, to projectingly support a surface finishing member 13.

Said finishing member 13 is locked against said bevel 144 by a clamp device which enables its operating position to be adjusted according to requirements. Specifically, said clamp device comprises an overlying presser plate 145 and an underlying series of clamping screws 146 which pass through the bracket 143 and screw into the presser plate 145.

The rear region of the presser plate 145 presents along its entire length a bevel facing the port 141 of the tubular member 14. At the opposing ends of the bracket 143 there are provided two shoe plates 147 which rest on the upper face of the die plate 2 external to the cavity 3.

The finishing member 13 comprises a relatively thin elongate plate or lamina positioned perpendicular to the sliding direction of the carriage 9.

The length of said lamina is greater than the corresponding dimension of the cavity 3, its free longitudinal edge being sharpened. In this respect, it presents along its entire extension a bevel facing the die plate 2 and practically in contact with it. As further shown in FIG. 5, the tubular member 14 is closed by two terminal transverse diaphragms 148, at least one of which presents an aperture 149 to which a suction tube 15 (see FIGS. 1–4) intercepted by a valve 99 is connected.

Said valve 99 is closed and opened by the outward and return travel strokes of the carriage 9, which are under the control of the overall ceramic press control system for their appropriate adjustments.

Said tubular member or manifold 14 is connected to the wall 111 of the loading compartment 11 by two end arms 16 by way of a connection and adjustment flange 166 (see FIG. 5). Between the lower edge of said flange 166 and the underlying sharp edge of the finishing member 13 there is defined a narrow gap through which atmospheric air is drawn into the manifold 14 to drag with it any dust 7 raised by said sharp edge.

If the wall 111 is made adjustable in height as stated hereinbefore, said two arms 16 are preferably connected to the lateral or side walls of the loading compartment 11.

The suction tube 15 is connected to an environment able to put the manifold 14 under vacuum, in order to remove the dust 7 which deposits by sliding along the ramp provided by the member 13.

As an alternative, said manifold 14 and said at least one suction tube 15 can be omitted, and the rear edge of the member 13 be associated with a channel housing a mechanical removal device such as a translating belt or a motorized screw.

If the cavity 3 is filled by the system of FIGS. 1 and 2, whether or not the wall 111 is made adjustable in height, the member 13 and the relative accessories can be relatively close to said wall 111 as shown. If however the loading system of FIG. 3 is used, the lower sharp edge of the member 13 must be spaced from the wall 111 by a distance at least equal to that dimension of the cavity 3 in the sliding direction of the carriage 9.

As a variant, the member 13 and the respective accessories can be free of the loading compartment 11 and be mounted on an independent drive unit under the control of the ceramic press control system. In that case said unit must be able to determine outward and return travel strokes of length at least equal to that dimension of the cavity 3 in the sliding direction of the carriage 9.

The aforegiven explanations relative to the operative position of the member 13 are also valid for the double loading system of FIG. 4. This shows a die plate 2 with relative forming cavity 3; a loading compartment 11 with relative grid 10; a hopper 18 with flow regulator valve 180 operated by a cylinder-piston unit 181 controlled by the ceramic press control system; and a surface finishing unit 17 of the already described type. Specifically, the loading compartment 11 is intended to contain a not particularly valuable powder material 71, i.e. suitable for forming the base or support part of the tile 6, whereas the hopper 18 is intended to contain a finishing material 77, i.e. able to provide the desired aesthetic characteristics for the exposed face of the tile.

Said finishing material 77 can comprise two powders with different characteristics, typically two differently coloured powder masses at least partially mixed together.

The lower edges of the loading compartment 11 and grid 10 are coplanar and preferably in line with the upper face of the die plate 2; the lower generators of the discharge port of the hopper 18 are preferably slightly spaced from the die plate 2; and the finishing member 13 is preferably positioned to graze the die plate 2.

Finally, in front of the manifold 14 the is a pusher 333 for removing the tiles 6.

With reference to FIGS. 1 and 2 the described means operate in the following manner.

On termination of a pressing operation the die 4 lies in its maximum raised position, not shown, where it supports the previously formed tile 6 while awaiting the grid 10.

When this advances, the pusher 333 urges the tile 6 onto the conveyor 5, and almost simultaneously the die 4 is brought into the illustrated position in which it frees the upper part of the cavity 3, which fills with multi-colour powder 7.

During the next retraction stroke of the grid 10, and by virtue of the distance existing between the die plate 2 and the lower edges of the grid 10 and wall 111, a thin layer of powder material forms on the surface defined by the upper face of the die plate 2.

Said thin layer is in excess because the quantity of powder 7 required to obtain the desired thickness for the tile 6 is defined by the depth of the cavity 3.

During the return of the carriage 9, towards the left in the figures, the finishing member 13 behaves in the manner of a blade which "sweeps" the upper mouth of the cavity 3 to collect the said excessive material. Specifically, the member 13 removes the surface powder layer subjected to scraping and mixing by the lower edges of the grid 10 and wall 111 (see FIG. 2), hence displaying the true sharp distribution of the at least two constituent materials of the multi-colour powder 7.

The material collected by the member 13 is removed continuously by applying suitable suction to the manifold 14.

After this, the other stages of the cycle take place, i.e. the lower die 4 firstly moves into its maximum lowered or pressing position, then the upper die 12 is lowered to form the tile 6, and finally the two dies 12 and 4 are raised nearly simultaneously, with the first 12 assuming the position shown in FIG. 1 and the second 4 lying flush with the die plate 2 to offer the tile 6 to the pusher 333.

With the embodiment of FIG. 3, the grid 10 and loading compartment 11 are practically in contact with the upper face of the table 8, and the multi-colour powder 7 is completely contained within the cavity 3 before the operation of the finishing member 13.

More specifically, during the retraction of the carriage 9 the die 4 is lowered by a distance equal to the thickness of the powder intended to form the tile 6 plus the thickness of the excess surface layer, said surface layer being flush with the loading compartment 11. The said lowered position of the die 4 is indicated in FIG. 3 by 991.

At this point it is possible to proceed in two modes.

A first mode consists of raising the die 4, after passage of the loading compartment 11 but before the arrival of the member 13, by a distance equal to the thickness of said surface layer, to make it available to the member 13 (FIG. 3). The second mode consists of lowering the die plate 2 by a distance equal to the thickness of said surface layer of powder 7, said lowering occurring preferably after the wall 111 of the loading compartment 11 has reached the operating table 8.

In that case the finishing member 13 is supported by its own drive unit by way of means which enable it to slide vertically. This is to enable it to rest on the die plate 2 when in the lowered position.

Said vertical sliding can be obtained either by automatic means or more simply by gravity. In addition, with the described loading system there is associated a processor 888 which is connected to the overall press control system to synchronously control the said vertical movements of the die 4 and die plate 2 in accordance with the two operative modes described with reference to FIG. 3.

A third loading mode for the cavity 3 is possible, consisting of maintaining the die 4 in the position shown by continuous lines in FIG. 3, and raising the combined loading compartment and grid 11-10 during the retraction of the carriage 9. Specifically, said combination 11-10 is spaced from the die plate 2 by an amount equal to the thickness of said surface layer and, once the wall 111 has passed beyond the cavity 3, the combination 11-10 is again lowered into its starting position. The surface layer of multi-colour powder 7 is removed as previously.

With the loading system of FIG. 4, during the return travel of the carriage 9 the die 4 becomes positioned at two different levels. When the die 4 occupies the higher level, the loading compartment 11 deposits into the cavity 3 the required quantity of base material 71, which is scraped by the wall 111.

When the wall 111 has passed, and before the discharge port of the hopper 18 reaches the cavity 3, the die 4 moves to the lower level to hence free the upper part of the cavity 3. Then the port of the hopper 18 reaches the right edge of the cavity 3, the valve 180 receives the command to open, to then close again when the hopper 18 reaches the left edge of the cavity 3. In this manner, on the base material 71 present on the bottom of the cavity 3 a layer of finishing material 77 is deposited to slightly project beyond the mouth of the cavity 3, this projecting part being removed by the member 13.

The merits and advantages of the invention are apparent from the aforegoing description and from the accompanying figures.

It need merely be added that the active face of the upper die 12 can be smooth or be relief contoured for the reasons explained in the introduction.

What is claimed is:

1. A method for loading ceramic moulds presenting a die plate having at least one forming cavity in which a die is slidingly received, comprising the following operative steps for each complete loading cycle:

preparing a powder layer at least the upper part of which has properties conforming to the required aesthetic characteristics of the exposed face of the tile, and transferring said layer to above said at least one forming cavity, characterised by comprising the following operative stages:

depositing into said at least one cavity a powder layer having a thickness greater than that necessary to obtain the desired tile thickness, and before pressing removing, by a mechanical cutting action with simultaneous removal of the thus separated material, the surface layer of the powder contained in the mould cavity, without appreciable mixing of the powder present at the interface between the surface layer and the underlying layer.

2. A method as claimed in claim 1, characterised in that said surface layer is created above the plane defined by the upper edge of said at least one forming cavity.

3. A method as claimed in claim 1, characterised in that said surface layer is created in the interior of said at least one forming cavity, flush with its upper edge.

4. A method as claimed in claim 3, characterised in that prior to said removal, said surface layer is raised beyond the upper surface of said at least one forming cavity.

5. A method as claimed in claim 4, characterised in that said raising is achieved by upwardly sliding the die relative to said at least one forming cavity.

6. A method as claimed in claim 4, characterised in that said raising is achieved by downwardly sliding the die plate relative to the die.

7. A plant for loading ceramic moulds provided with forming cavities, comprising a loading carriage presenting a loading compartment provided with a grid for retaining the powders, and driven with horizontal reciprocating rectilinear movement between a retracted position in which it disposes the grid below at least one hopper for supplying a mass of ceramic powder, and an advanced position in which it disposes the grid above the forming cavity of a mould, characterised by comprising a movable implement which is arranged to translate along said forming cavity, and presents a finishing member positioned a short distance from the upper edge of said forming cavity in order, before pressing, to remove a small upper surface layer of powder without any mixing.

8. A plant as claimed in claim 7, characterised by comprising means for creating, in correspondence with said forming cavity, a powder layer exceeding that necessary for obtaining the required tile thickness.

9. A plant as claimed in claim 8, characterised in that the excess powder layer has a thickness of 0.1–4 mm.

10. A plant as claimed in claim 8, characterised in that said means are shaped in such a manner as to dispose said excess layer beyond the upper edge of said forming cavity.

11. A plant as claimed in claim 10, characterised in that said means are provided by the front transverse wall of the loading compartment and of the grid.

12. A plant as claimed in claim 11, characterised in that said front wall and said grid are adjustable in height.

13. A plant as claimed in claim 12, characterised in that said height adjustment is achieved by manual means.

14. A plant as claimed in claim 10, characterised in that said means are provided by the combination of the loading compartment and grid, said combination having its lower edges positioned in the same plane and being connected to the respective support structure by a unit able to vary its position in height relative to the die plate.

15. A plant as claimed in claim 8, characterised in that said means are means for raising the die contained in said forming cavity.

16. A plant as claimed in claim 8, characterised in that said means are means that lower the die plate defining said forming cavity.

17. A plant as claimed in claim 7, characterised in that said finishing member consists of relatively thin flat elongate body positioned transversely to the direction of movement of the carriage and having a length greater than the corresponding dimension of said at least one cavity, it being transversely inclined to define, with the mouth of said at least one cavity, an angle with its vertex facing the carriage, the lower edge of said body presenting along its entire extension a bevel which is virtually parallel to the mould die plate.

18. A plant as claimed in claim 17, characterised in that means are associated with the upper edge of said body to remove the powder raised by the body.

19. A plant as claimed in claim 18, characterised in that said removal means comprise a manifold which presents a suction port close to the upper edge of said body, and is connected to a vacuum environment.

20. A plant as claimed in claim 19, characterised in that the connection between said port and said vacuum environment is intercepted by a valve member arranged to close and open synchronously with the outward and return movement of the carriage.

21. A plant as claimed in claim 18, characterised in that said removal means comprise a channel situated behind the upper edge of said body and presenting in its bottom part a conveyor means such as a belt or a motorized screw.

22. A plant as claimed in claim 7, characterised in that said movable implement is rigid with said carriage.

23. A plant as claimed in claim 7, characterised in that between said loading compartment and said finishing member there is interposed a powder-containing hopper, the discharge port of which is positioned a short distance from the die plate and is intercepted by a flow regulator valve.

24. A plant as claimed in claim 7, characterised in that said finishing member is spaced from the loading compartment by an amount at least equal to that dimension of the forming cavity in the carriage travel direction.

25. A plant as claimed in claim 23, characterised in that said finishing member is spaced from said hopper by an amount at least equal to that dimension of the forming cavity in the carriage travel direction.

26. A plant as claimed in claim 7, characterised in that said finishing member is slidingly carried by said movable implement and is controlled by a control unit arranged to cause it to slide forwards and backwards by an amount at least equal to that dimension of the forming cavity in the carriage travel direction.

27. A plant as claimed in claim 7, characterised in that said finishing member is supported by said movable implement by way of interposed means enabling it to be adjusted in height.

* * * * *